US011805892B2

(12) United States Patent
Solomon

(10) Patent No.: US 11,805,892 B2
(45) Date of Patent: Nov. 7, 2023

(54) CONVERTIBLE CHAIR

(71) Applicant: Brett Matthew Solomon, Los Angeles, CA (US)

(72) Inventor: Brett Matthew Solomon, Los Angeles, CA (US)

( * ) Notice: Subject to any disclaimer, the term of this patent is extended or adjusted under 35 U.S.C. 154(b) by 0 days.

(21) Appl. No.: 18/116,156

(22) Filed: Mar. 1, 2023

(65) Prior Publication Data

US 2023/0200531 A1 Jun. 29, 2023

Related U.S. Application Data

(63) Continuation of application No. 17/553,355, filed on Dec. 16, 2021, now Pat. No. 11,617,440.

(60) Provisional application No. 63/126,503, filed on Dec. 16, 2020.

(51) Int. Cl.

| | |
|---|---|
| ***A47C 31/00*** | (2006.01) |
| ***A47C 7/62*** | (2006.01) |
| ***A47C 13/00*** | (2006.01) |
| ***A47B 85/04*** | (2006.01) |
| ***A47C 7/66*** | (2006.01) |
| *A47C 7/00* | (2006.01) |

(52) U.S. Cl.

CPC ..... *A47B 85/04* (2013.01); *A47C 7/66* (2013.01); *A47C 13/00* (2013.01); *A47C 7/006* (2013.01)

(58) Field of Classification Search

CPC ..... A47C 13/00; A47C 7/66; A47C 7/666; A47C 7/68; A47C 11/00; A47C 1/14; A47C 7/628; A47C 1/143; A47C 17/165

See application file for complete search history.

(56) References Cited

U.S. PATENT DOCUMENTS

| | | | | |
|---|---|---|---|---|
| 33,192 A * | 9/1861 | Gurley | A47C 17/165 297/109 |
| 4,883,317 A * | 11/1989 | Davenport | A47C 7/62 297/188.1 |
| 5,622,404 A | 4/1997 | Menne | |
| 5,727,844 A | 3/1998 | O'Quinn et al. | |
| 6,129,400 A | 10/2000 | Jakubiec et al. | |
| 6,367,873 B1 | 4/2002 | Dorner et al. | |

(Continued)

FOREIGN PATENT DOCUMENTS

| | | |
|---|---|---|
| CN | 111820658 A | 10/2020 |
| DE | 2700706 A1 | 7/1978 |

OTHER PUBLICATIONS

Invitation to Pay Additional Fees for PCT/US2021/063875 dated Apr. 4, 2022, 15 pages.

(Continued)

*Primary Examiner* — Shin H Kim

(74) *Attorney, Agent, or Firm* — PROCOPIO, CORY, HARGREAVES & SAVITCH LLP

(57) ABSTRACT

Convertible chairs that can be converted to and from an open chair configuration to a box or table configuration for storage and protection of the interior portions is provided. The convertible chairs can have include one or more of a sunshade, adjustable foot rest, legs, wheels, and can in some embodiments be a reclining chair. In some aspects, a cover portion can be used to cover a portion of the interior portions of the chair when the convertible chair is in a box configuration, and be folded and retracted into a pocket of the convertible chair when in an open chair configuration.

13 Claims, 11 Drawing Sheets

(56) References Cited

U.S. PATENT DOCUMENTS

| | | | | |
|---|---|---|---|---|
| 7,128,369 | B2 | 10/2006 | Boggs et al. | |
| 7,309,106 | B2 | 12/2007 | Stallman | |
| 7,568,767 | B2 * | 8/2009 | Richardson | A47C 4/028 297/440.1 |
| 8,152,233 | B2 | 4/2012 | Wechter | |
| 8,262,159 | B2 | 9/2012 | Daniels, Jr. | |
| 9,307,840 | B2 * | 4/2016 | Restrepo | A47C 7/62 |
| 10,694,866 | B2 | 6/2020 | Claypoole | |
| 2006/0249998 | A1 | 11/2006 | Westendorf et al. | |
| 2008/0157571 | A1 | 7/2008 | Richardson | |
| 2015/0130233 | A1 | 5/2015 | Thuma et al. | |
| 2016/0000228 | A1 | 1/2016 | Restrepo et al. | |
| 2022/0183463 | A1 | 6/2022 | Solomon | |

OTHER PUBLICATIONS

International Search Report and Written Opinion for PCT/US2021/063875 dated May 25, 2022, 21 pages.

* cited by examiner

CONVERTIBLE CHAIR

CROSS-REFERENCE TO RELATED APPLICATION

This application claims priority to U.S. patent application Ser. No. 17/553,355, filed on Dec. 16, 2021 which claims priority to U.S. patent application No. 63/126,503, filed on Dec. 16, 2020. These and all other extrinsic materials discussed herein, including publications, patent applications, and patents, are incorporated by reference in their entirety. Where a definition or use of a term in an incorporated reference is inconsistent or contrary to the definition of that term provided herein, the definition of that term provided herein applies and the definition of the term in the reference does not apply.

FIELD OF THE INVENTION

The present invention relates to convertible chairs, especially convertible chairs for outdoor use and convenient storage.

BACKGROUND

Leisurely enjoying the outdoors is an ideal setting for relaxation. The best outdoor experiences for many involve a combination of comfort, cleanliness, spontaneity, complacency and affordability. Unfortunately, no matter what climate someone lives in, the elements constantly erode these elusive and expensive qualities of outdoor furniture. The rain, dirt, sun, snow, leaves, pets, grime, dust, dew, salt, bugs, mold, mildew, critters, bird droppings, and of course the most destructive enemy, UV deterioration, destroy outdoor furniture if it is not protected. Furthermore, most outdoor chairs are not very comfortable nor do they have all of the features of an indoor furniture as many manufacturers focus on durability while giving up comfort and functionality.

SUMMARY OF THE INVENTION

Provided herein are convertible chairs that can be used and stored outdoors. The convertible chairs are comfortable and can include a wide range of functionalities and features, and can be converted into a box or table that encloses elements that are typically destroyed over time by the elements outdoors.

In some aspects, a convertible chair comprises a first side portion (e.g., a right side portion), a second side portion (e.g., a left side portion), a seat portion extending between the first side portion and the second side portion, the seat portion optionally forming a bottom portion of the box when the convertible chair is in a closed box configuration), a back portion extending between the first side portion and the second side portion, and a top portion hingedly coupled to the back portion on a first edge and hingedly coupled to a front portion on a second edge. The convertible chair is configured to convert from a closed box configuration to an open chair configuration. It should be appreciated that a closed box configuration can comprise one or more gaps or openings, for example, to allow air flow from beneath the convertible chair. In some aspects, each of the first side portion, second side portion, seat portion, back portion, top portion, and front portion can comprise separate pieces coupled or attached to one another. In some aspects, the first side portion, second side portion and seat portion can be a single piece. In some aspects the convertible chair comprises a chair frame that includes the first and second side portions, the seat portion, and the back portion. In some aspects, a convertible chair is a recliner with a recliner frame coupled to the chair frame. Legs can extend from a lower surface of the chair frame. A cover that comprises the top portion and front portion can be deployed from and retracted into a pocket of the back portion. Additionally or alternatively, a cover that comprises the top portion and front portion can be rotated or pivoted up and above (or even partially or fully behind) the back portion without being retracted into a pocket.

The top portion and front portion can be adjustable from a box configuration to a folded configuration to a sunshade configuration. The top portion and front portion can be parallel to one another with the front portion is front of the top portion in the folded configuration. The top portion and the front portion can form an angle of between 45 and 170 degrees and the top portion and the back portion form an angle of between 120 and 225 degrees in the sunshade configuration. The top portion can form an angle of about 90 degrees with each of the back portion and the front portion, with the front portion positioned in front of the back portion, in the box configuration.

The back portion can comprise a pocket sized and dimensioned to receive at least a portion of the top portion (e.g., at least 70%, at least 80%, at least 90% or 100%). The pocket can be sized and dimensioned to receive at least a portion of the front portion (e.g., at least 70%, at least 80%, at least 90% or 100%). The pocket can be sized and dimensioned to receive at least 70%, at least 80%, at least 90% or 100% of each of the top and front portions. In some aspects, the pocket can house a retraction and deployment mechanism, for example, comprising two parallel rack and pinion pairs operatively coupled to one another through a synchronizing axle.

A set of legs (e.g., 1, 2, 3, 4, 5, or more legs) can extend downwardly from the lower surfaces of the seat, side, back or other portions. In some aspects, each leg of the set of legs can comprise at least one of a wheel and a caster to allow for easy movement of the convertible chair between different locations. In some aspects, the at least one of a wheel and a caster can comprise a stopper, a lock, or a brake (e.g., a locking caster or a braking caster).

In some aspects, the convertible chair can comprise a reclining chair. The back portion can be configured to recline from a first configuration wherein the back portion and the seat portion form an angle of about 90 degrees to a second configuration wherein the back portion and the seat portion (or ground the chair is placed on) form an angle of between 115-180 degrees. It is contemplated that the back portion can be locked at multiple positions relative to the ground. The seat portion can be coupled to an adjustable foot rest. A recliner frame can be coupled to each of the foot rest and the back portion such that an adjustment of an angle of the back portion relative to the seat portion or ground causes an adjustment of an angle of the foot rest relative to the seat portion or ground. In some aspects, an adjustment of the foot rest causes an adjustment of the back portion.

The first side portion can comprise a first upper armrest panel that is hingedly coupled to a side wall portion of the first side portion. The first upper armrest panel can be adjustable about 180 degrees from a closed configuration to an open configuration. The second side portion can comprise a second upper armrest panel that is hingedly coupled to a side wall portion of the second side portion. The second upper armrest panel can be adjustable about 180 degrees from a closed configuration to an open configuration. The open configuration can be useful in providing a larger surface for placement of an arm, a drink, food, a phone, or any other item.

One or more sets of magnets can be provided along various portions of the convertible chair (internally to a panel or portion, or on an outer surface of the panel or portion) that can help maintain the convertible chair or portion thereof in a selected configuration. For example, a set of magnets can be positioned within the first and second side portions and the front portion to help maintain the convertible chair in the closed box configuration. As another example, where a side portion is hingedly coupled to an upper armrest panel such that the upper armrest panel is adjustable about 180 degrees from a closed configuration (where the upper armrest panel is positioned on top of the side portion) to an open configuration wherein the upper armrest panel is parallel to and adjacent an upper surface of the side portion), a set of magnets may be provided on the upper armrest panel and side portion to help maintain the upper armrest panel in the closed configuration when a larger surface is not needed.

Other advantages and benefits of the disclosed compositions and methods will be apparent to one of ordinary skill with a review of the following drawings and detailed description.

BRIEF DESCRIPTION OF THE DRAWINGS

The novel features of the disclosure are set forth with particularity in the appended claims. A better understanding of the features and advantages of the present disclosure will be obtained by reference to the following detailed description that sets forth illustrative embodiments, in which the principles of the disclosure are utilized, and the accompanying drawings of which:

DETAILED DESCRIPTION

Figure 1:
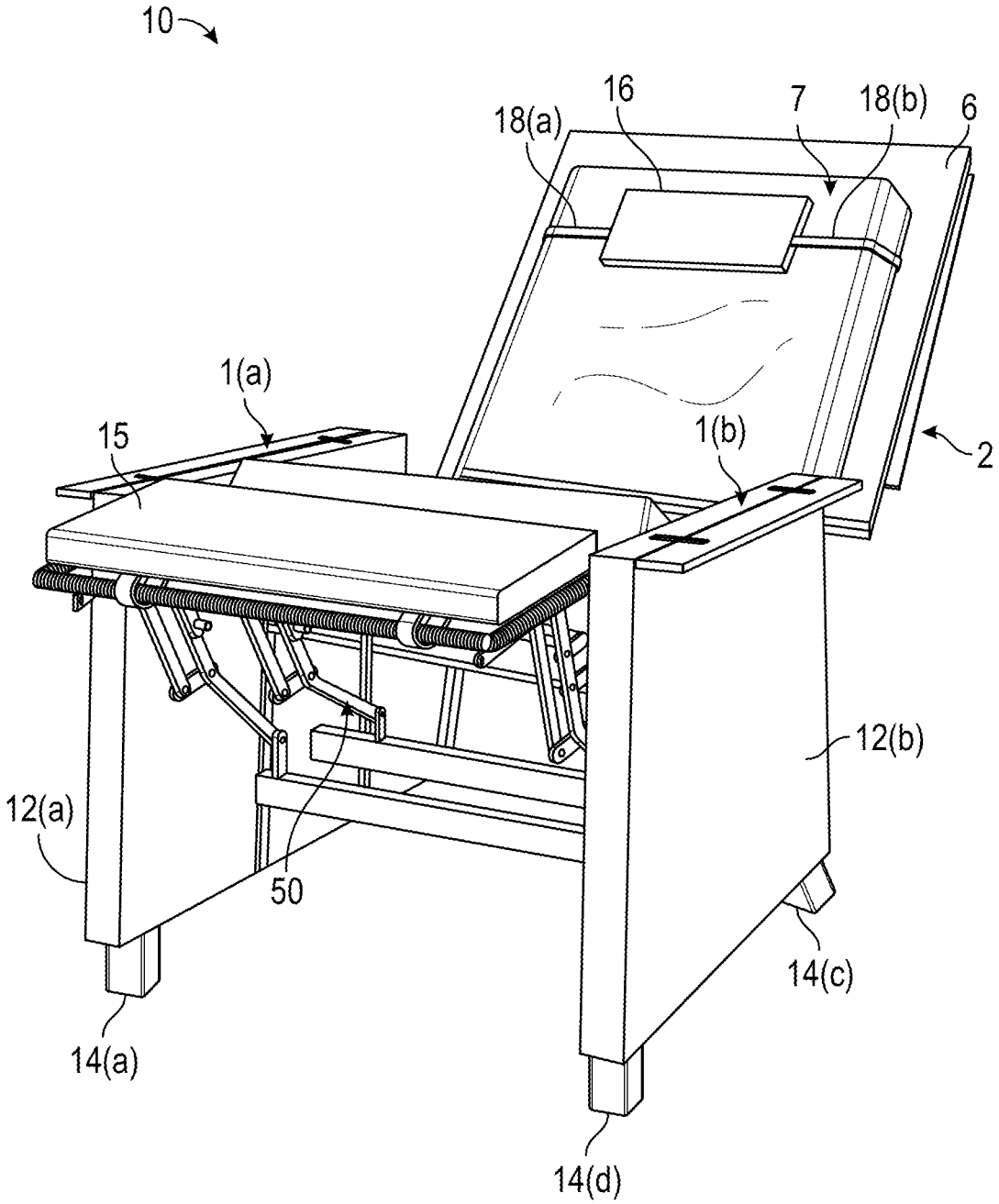
FIG. 1 is an illustration of an embodiment of a convertible chair of the inventive subject matter in a reclined configuration.

Provided herein are convertible chairs that can be used and stored outdoors. The convertible chairs are comfortable and can include a wide range of functionalities and features, and can be converted into a box or table that encloses elements that are typically destroyed over time by the elements outdoors. In some aspects, the chairs can be comparable in comfort to the most luxurious of indoor recliners, while offering multiple features which adapt it perfectly for outdoor use. The chair can be easily turned into at least one of a table and a box, which allows it to be stored and keep it protected from the elements, especially the internal cushioning components. The construction of the chair and the tightness of the closure of the chair into a box in some embodiments can inhibit most elements from reaching the cushions of the chair when it is being stored. Additionally, the inventive convertible chairs are very comfortable and can have any and all the features of an indoor chair or recliner. In some embodiments, the chair can have a sunshade component to protect its user from the harsh rays of the sun, and can have multiple sitting positions available. An innovative built-in protective cover component can comprise a top portion and a front portion (the top portion forming the top when the convertible chair is in a box configuration; the front portion forming the front when the convertible chair is in a box configuration). The front portion can rotate relative to the top portion and maintain or lock in place in different configurations to act as a sunshade or allow for full sun exposure, when desired, while the top portion can rotate relative to the back portion and lock in place in different configurations to act as a top of a box, a seat back portion, a headrest portion, or stowed away in a pocket of the back portion. For example, one or more torque hinges or locking hinges may be provided between one or more of the front portion and top portion, and the top portion and the back portion (or any other components), which can reduce or eliminate the risk of an inadvertent closing or moving of the cover component. It is contemplated that the chair can be operated with a single hand, and can fold-to-close, which can effortlessly seal away or otherwise cover the cushions and arm rests to protect them until the next use as a chair. When the chair is closed it can form a box shape which can be easily stored or can also function as a table. In some embodiments, a lock may be provided, for example, to lock a front portion of the chair to a bottom or other portion of the chair when in a box configuration. In some embodiments, when the convertible chair is closed, all the contact surfaces of the chair are substantially protected from the elements while allowing free airflow from underneath (e.g., via a gap formed between the front portion, side portions, and a footrest or seat portion or via vent holes) to prevent moisture build-up. When open, some convertible chair positions range from sitting up (e.g., with the back portion substantially orthogonal to the seat portion or ground) to fully reclined sunbathing or sleeping under the stars (e.g., with the back portion substantially forming a 180 degrees angle with the seat portion), and anywhere in between (e.g., the back portion and seat portion forming an angle of between 90-180 degrees, between 95-175 degrees, between 120-165 degrees). Viewed from another perspective, it is contemplated that a convertible chair of the inventive subject matter can have a back portion that is adjustable relative to the seat portion or ground the chair is placed on to form an angle of between 90-180 degrees. Viewed from another perspective, it is contemplated that a convertible chair of the inventive subject matter can have a back portion that is adjustable relative to the seat portion or ground it is placed on to at least 2, at least 3, at least 4, or at least 5 lockable positions forming different angles of between 90-180 degrees. Never before has clean outdoor comfort been so effortless.

Embodiments described herein provide an outdoor convertible chair, optionally a recliner chair, which can be positioned into one or more chair configurations and can be compacted into a box or table configuration. The embodiments described herein can be a single seat chair, or a larger double, triple, quadriple, quintuple, etc. seat chair (e.g., a loveseat or couch), all of which can be turned into a box or table. Thus, it should be appreciated that the term "chair" can include a multi-seat furniture item that several people can sit on, as well as a single seat furniture item. When the chair is in the box or table position the cushions and other components/surfaces of the chair that are entirely enclosed or substantially enclosed (e.g., enclosed from the top and sides and substantially enclosed from the bottom) are advantageously protected from the elements. Additionally, in some embodiments, in the closed position air can freely flow through portions of the chair from underneath the chair preventing moisture build-up.

The convertible chairs of the inventive subject matter have several advantages over known chairs, including some or all of the following advantages.

Reduction of damage: the damage the elements cause to outdoor furniture can drastically reduce their lifespan and therefore require more frequent replacement. The inventive subject matter reduces the exposure time by allowing contemplated chairs to be easily converted with one hand into a box for storing it (and optionally other items) and protecting it from the elements. This ease of protection is much less effort and expense of the traditional outdoor furniture which must be covered by furniture covers, frequently replaced in whole or in part (e.g., cushions), or dragged inside after every use.

Spontaneity: lack of spontaneity is one of the largest drawbacks to outdoor furniture usability. Enjoying the outdoors is a favorite setting for many people. But the elements cause the opportunities for outdoor furniture usage to be intermittent. When free time coincides with nice weather the opportunity is hopefully acted upon. However, without constant maintenance, outdoor furniture requires a decent amount of preparation before usage. Removing unwieldy and unattractive covers, retrieving cushions from protective deck boxes, or cleaning, any of these can diminish the user friendliness of outdoor chairs. The inventive subject matter eliminates or reduces the need for such unattractive covers, movement of cushions to and from separate protective deck boxes, and cleaning, and provides for a chair that can be converted from a box to a chair, or from a chair to a box, with ease (e.g., with a single action of lifting the protective cover, with a single action of closing the protective cover, by lifting the protective cover by a handle, allowing it to fold and retract into a pocket of the chair, by lifting the folded protective cover out of the pocket, allowing it to unfold and close with the top portion over the seat and side portions and the front portion in front of the seat and side portions).

Comfort: Few would describe outdoor seating comparable in comfort to indoor seating. Mainly because maintaining plush outdoor cushions and upholstery is time consuming and expensive. Therefore, a compromise is made by reducing comfort in exchange for durability. The invention dramatically reduces this concern, allowing more delicate and comfortable seating surfaces, which can be stored away within the chair when in a closed box configuration.

Aesthetics: the convertible chairs described herein offer improved aesthetics in several ways. In the closed position, the chair offers an attractive built in cover, which is an improvement upon a durable soft cover. With the ease of protection, the reduced time interval of exposure to the elements allows the vulnerable surface areas to stay more pristine and attractive, and for more aesthetically pleasing materials to be used.

After reading this description it will become apparent to one skilled in the art how to implement the invention in various alternative embodiments and alternative applications. However, all the various embodiments of the present invention will not be described herein. It is understood that the embodiments presented here are presented by way of an example only, and not limitation. As such, this detailed description of various alternative embodiments should not be construed to limit the scope or breadth of the present invention as set forth below.

Figure 2:
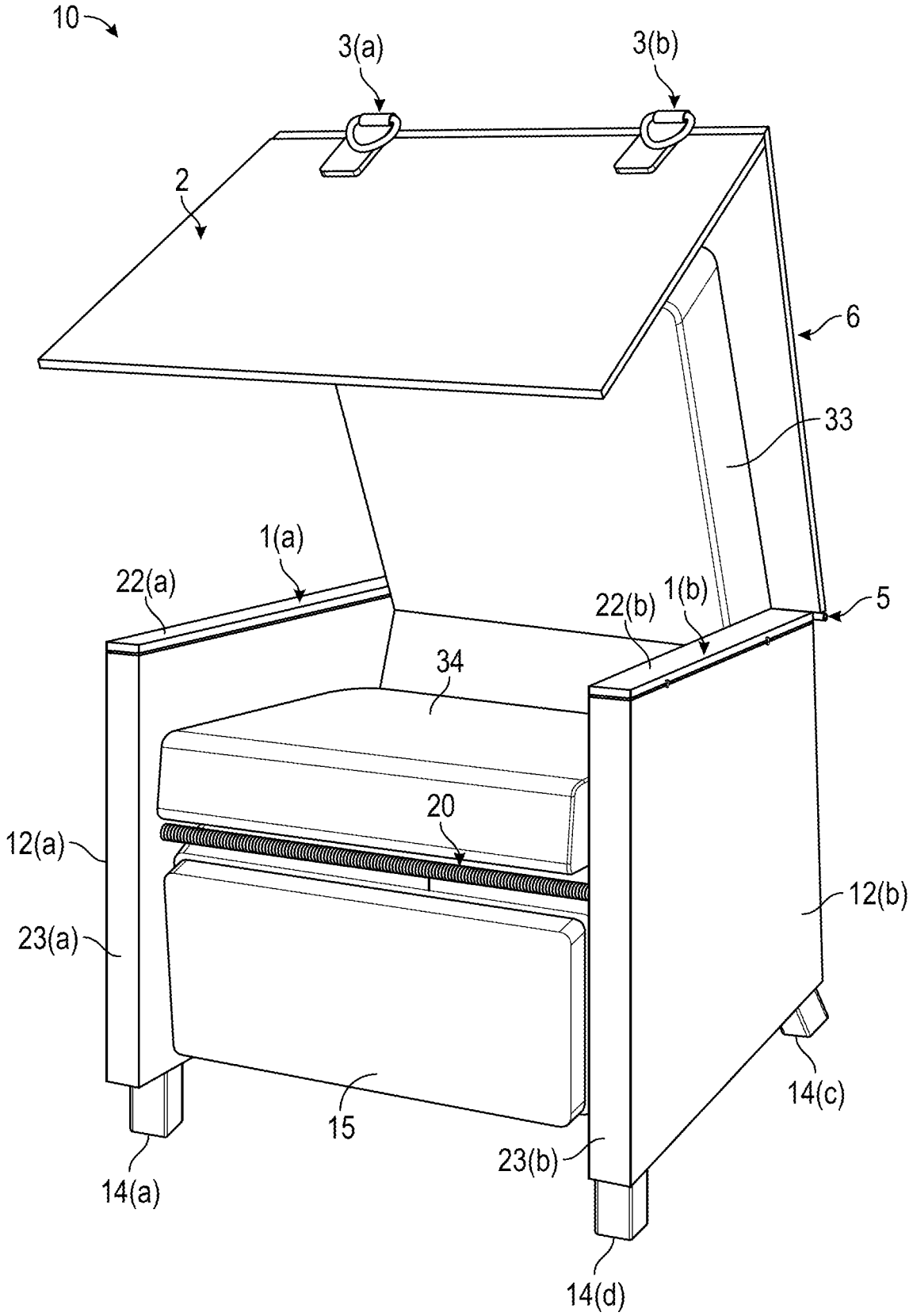
FIG. 2 is an illustration of the chair of FIG. 1 in the process of being moved from an open chair configuration to a closed box configuration.
Figure 3:
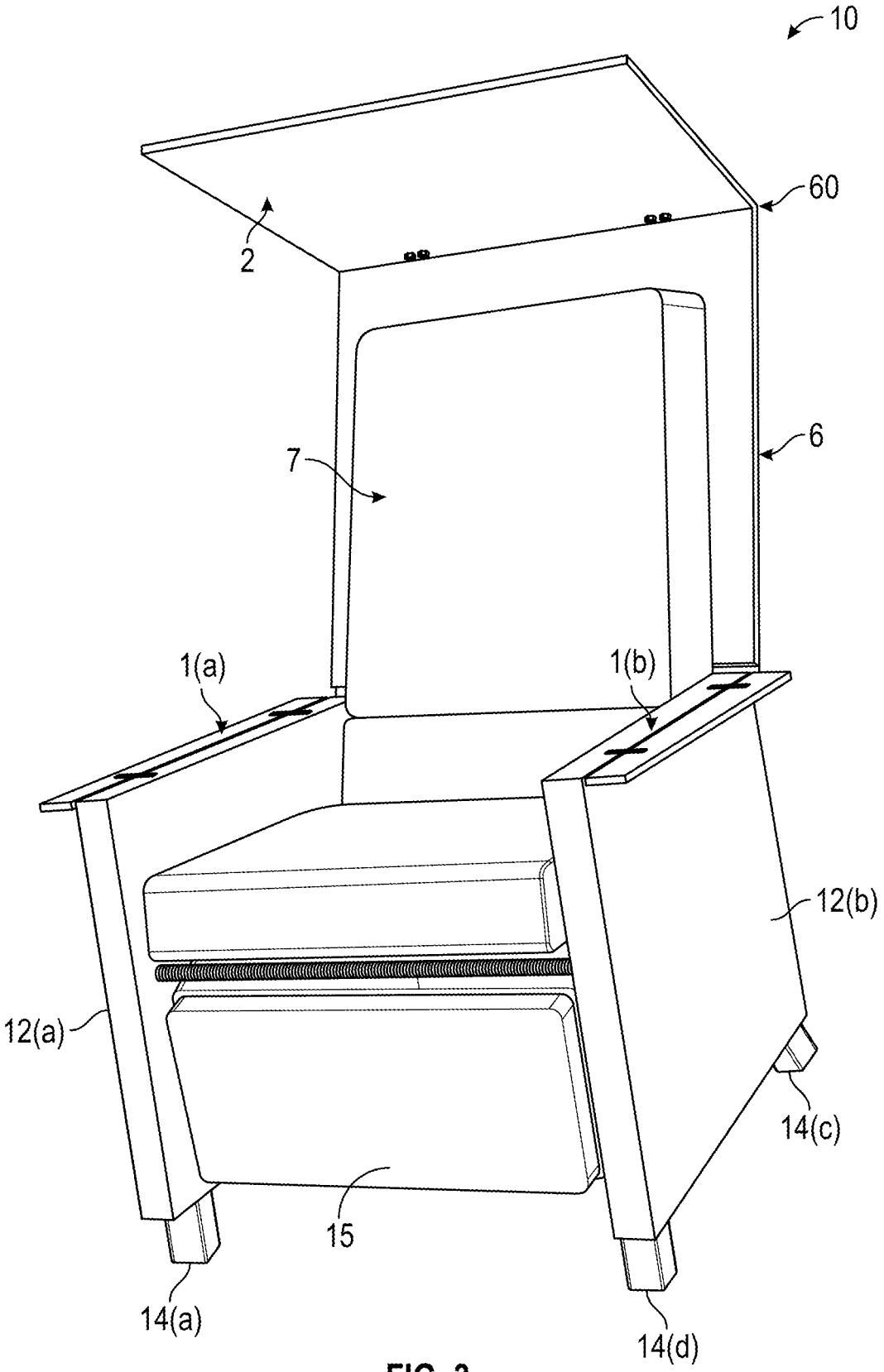
FIG. 3 is an illustration of the chair of FIG. 1 in an open chair configuration with the front panel open as a sunshade.
Figure 4:
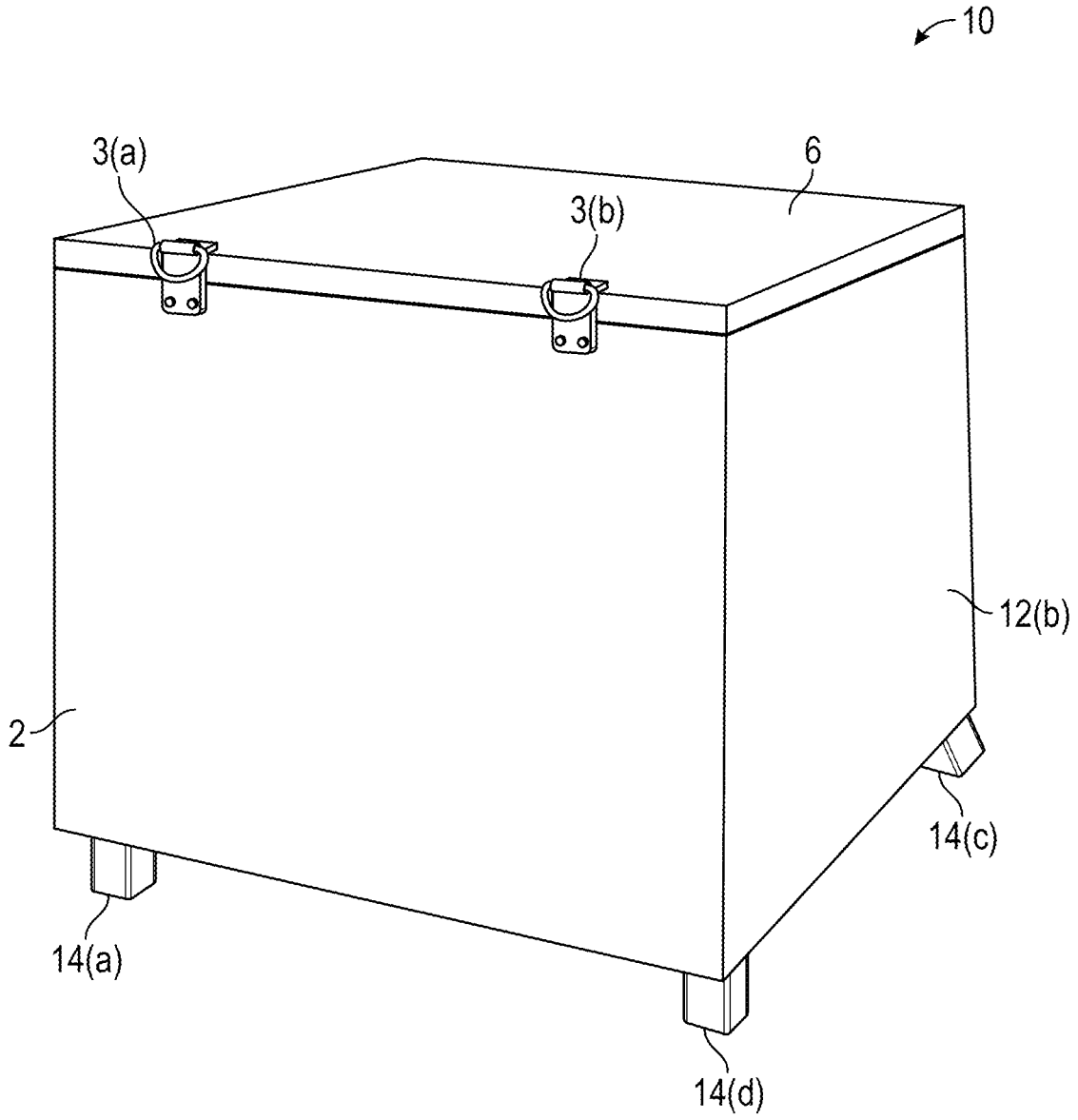
FIG. 4 is an illustration of the chair of FIG. 1 in a closed box configuration.

FIGS. 1-4 illustrate an embodiment of a convertible chair of the inventive subject matter. FIG. 1 illustrates convertible chair 10 in an open chair and reclined configuration. Convertible chair 10 comrpises a front portion/sunshade 2, top portion/back rest 6, right side portion 12(*a*), second side portion 12(*b*), seat portion 20, and foot rest 15. The back rest or top portion 6 of the recliner is leaning back at approximately a 125-degree angle from its original horizontal position as shown in FIG. 4 where the back rest forms a top portion of the convertible chair in a closed box configuration. The back rest/top portion 6 can be coupled to a back portion (not shown) that forms a back side of the convertible chair when in a box configuration via a hinge mechanism 5 (e.g., torsion/position/torque/friction or other hinge). It should be appreciated that the back rest/top portion 6 can be placed into and be maintained in multiple positons to provide a variety of angles to the user while being used (e.g., upright at 90 degrees (or vertical) to reclined at between 110-145 degrees, to laying down flat at 180 degrees, optionally with multiple settings/locking positions in between). FIG. 1 illustrates convertible chair 10 in a reclined position showing portions of the recliner frame 50 coupled to the chair frame (e.g., seat portion 20, foot rest 15).

FIG. 2 illustrates convertible chair 10 in the process of being moved from an open chair configuration to a closed box configuration. The back rest or top portion 6 can comprise or be coupled to a cushion 7 to add comfort which can be made of any suitable material(s), including for example, leather, suede, fabric, linen, velvet, feathers, foam, gel, or a combination thereof. In some embodiments, the cushion 7 can be comprised of multiple sections. For example, cushion 7 can comprise three sections, an upper section which rests against the back rest or top portion 6, a middle section which rests at the lower portion of the back rest, and a bottom section which sits on the seat portion 20 of the chair. When the chair is in its closed box configuration, the upper section of the cushion can lay on top the bottom section of the cushion. In some embodiments, the back rest and seat portions can comprise or be coupled to separate cushions (e.g., a first cushion coupled to the back rest and a second cushion coupled to the seat portion. Additional cushions may be provided (e.g., coupled to the foot rest 15, between the first and second cushion). When the chair is in its closed box configuration, the first cushion can lay on top of the second cushion with the laying side 33 of the first cushion facing the laying side 34 of the first cushion. As used herein, the "laying side" is a side of a cushion opposite the side of the cushion that contacts the back rest, seat portion, or other portion. Viewed from another perspective, the "laying side" is a side of the cushion that the user sits or lays on when the convertible chair is in an open chair configuration. Each cushion or cushion portion can be removably or fixedly attached to a back rest or any other portion (e.g., seat portion, foot rest) via any suitable attachment mechanisms. For example, where a multi segment cushion is provided, the upper section of this cushion 7 (shown over back rest 6) can be removably or fixedly attached to the back rest or top portion 6 by any suitable attachment mechanism, including for example, via hook and loop fasteners, via snaps, via zipper fasteners, or by way of a "Footman's loop" which can be attached to a portion of the back rest 6 (e.g., an upper central portion). A top or other portion of the upper section of the cushion 7 can have a fastening strap sewn onto it which then attaches to the "Footmans's loop" on the back rest 6 holding the cushion in place against the back rest but still allowing the chair to fold into a box and the cushion to slide into place. Optionally additional attachment mechanisms can be provided to removably or fixedly attach other segments of the cushion to other portions of the convertible chair (e.g., a bottom segment of the cushion to a seat portion of the convertible chair). As shown in FIG. 1, the upper section of the cushion can also have or be coupled to a head bolster 16. In some aspects, the head bolster can removably attach to the cushion 7 by way of hook and loop fasteners. In some aspects, the head bolster can be placed over a portion of cushion 7 via straps 18(*a*) and 18(*b*) which can wrap around the upper section of the cushion 7 and connect on the back side to each other by way or Velcro or another attachment device to hold the head bolster tight on the upper section of the cushion. The straps can be wide so that they prevent buckling. The straps 18(*a*) and 18(*b*) can attach to either side of the head bolster 16 and each wrap around the back of the upper (or other) section of the cushion where horizontal loops of fabric can be attached so that the straps 18(*a*) and 18(*b*) can keep the head bolster 16 securely fastened and prevent it from sliding and interfering with the closure of the chair.

An edge of the back rest 6 by way of one or more hinges 60 or other attachment mechanisms can be coupled to a sunshade 2 which also functions as the front lid or cover when the convertible chair is in its closed box or table configuration. When the cover (top portion/back rest 6 and front portion/sunshade 2) is in it's folded out open position, the sunshade 2 can be positioned above the user's head and protect the user's face and head from the harmful rays of the sun. The sunshade 2 can fold in conjunction with the back rest 6 such that the sunshade 2 closes/serves as a front portion of the box while the back rest 6 closes/serves as a top portion of the box when the convertible chair is in a closed box configuration. The sunshade 2 and back rest 6 can form a seal with the upper edges 22(*a*), 22(*b*) (or arm rest portions) and front edges 23(*a*), 23(*b*) of the side portions 12(*a*), 12(*b*). The seal can be formed or maintained, for example, via one or more magnetic door catches. In some embodiments, a sealing device such as a silicone or rubber seal strip may be provided to ensure internal components of the chair are protected from the environment and weather changes. In some embodiments, the convertible chairs described herein can be weatherproof or weather resistant, such that the convertible chairs can be left outside in the rain or snow in a closed box configuration without damaging (or substantially damaging) the chair. In some embodiments, air can flow through from under the seat through the upholstery and cushions, for example, as shown by arrow A. The hinges of convertible chair 10, for example, the hinges coupling back rest 6 and sunshade 2 can be torsion hinges so that the shade can be fixed at various angles.

The convertible chair 10 has a seat portion 20 that can be coupled to the back rest 6 which can be adjusted into an upright or reclined position. Seat portion 20 can be directly coupled to the back rest via a hinge assembly, or can be indirectly coupled to the back rest (e.g., via a hinge or other coupling assembly and the back portion of the convertible chair) Adjustably coupled to the seat portion 20 can be a foot rest 15 which can be folded in as seen in FIG. 2 or can be extended out as seen in FIG. 1 so that the user can rest their feet and legs and lay in a reclined position. The chair has a right side portion 12(*a*) and a left side portion 12(*b*) and on the upper end of each side portion are the arm rest panels 1(*a*) and 1(*b*). The right side portion 12(*a*) can comprise a first arm rest panel 1(*a*) that is hingedly coupled to a side wall portion of the right side portion. The first arm rest panel can be adjustable about 180 degrees from a closed configuration to an open configuration. The left side portion 12(*b*) can comprise a second arm rest panel 1(*b*) that is hingedly coupled to a side wall portion of the left side portion. The second arm rest panel can be adjustable about 180 degrees from a closed configuration to an open configuration. In some aspects, the arm rest panels open inward towards the seat. In some aspects, the arm rest panels open outwardly away from the seat. The open configuration can be useful in providing a larger surface for placement of an arm, a drink, food, a phone, or any other item.

The chair can also have legs 14(*a*), 14(*b*), 14(*c*) and 14(*d*) which can be attached to the front and back lower end of each side portion, or along any other suitable portion of the chair. In an alternate embodiment of the chair the foot rest 10 can tuck all the way under the seat so that it lays parallel to and under the seat when it is tucked up. When the foot rest 10 is in this position the feet of the chair can be longer giving the chair longer legs.

The recliner can have a cushion 7 as described above which extends over a first surface of the back rest 6 onto a first surface of the seat portion. In a preferred embodiment this cushion is comprised of three sections with seams between each allowing the cushion 7 to follow the angles of the chair when it is placed in its various positions including being upright, reclined or folded into a box. The upper portion of the cushion is attached to the upper portion of the back rest 6 by way of a "Footman's loop". Referring to FIG. 1 an upper back head bolster cushion 16 can be attached to the top of the cushion for extra comfort as described above. In the embodiment shown in FIG. 1, the head bolster 16 is attached to the cushion by way of two wide straps 18(*a*) and 18(*b*) which wrap around the back of the cushion. The straps 18(*a*) and 18(*b*) are fastened with Velcro® or another attachment device at the rear of the cushion. The horizontal loop keeps the straps 18(*a*) and 18(*b*) tight and stops the cushion from sliding to the point of interfering with the door closure. The connecting straps are wide so that they prevent buckling when the chair is converted into a box.

FIG. 3 illustrates convertible chair 10 in an open chair configuration with the front panel open as a sunshade. FIG. 4 illustrates convertible chair 10 in a closed box configuration. The convertible chair 10 is a recliner that provides a novel protection of the contact surfaces or laying surfaces and upholstery apparatus generally comprising or consisting of the top portion/back rest 6, the hinged articulation axis 60 and front panel/sunshade 2, which rotates or pivots open from the closed box configuration to the open chair configuration, creating the "chair back lid" protection cover. When the recliner is closed and, in its box or table configuration, all of the user contact surfaces (the surfaces of the chair the user sits/lays on when the chair is in an open chair configuration) and vulnerable upholstery are protected from the elements, as shown in FIG. 4. The sunshade 2 can fold to form about a 90 degree angle with the back rest 6 via hinged axis 60 for positioning along the front of the side portions 12(*a*), 12(*b*), sealing the lower exposed upholstery and cushions. When the recliner is in an open chair configuration, as shown in FIG. 3, the seat back 6 can be locked vertically or at any other suitable angle relative to horizontal (e.g., with the seat back 6 and arm rests 1(*a*), 1(*b*) forming an angle of between 90-180 degrees). The front portion of the convertible chair in a closed box configuration can be used as a sunshade 2 or articulated in any position (e.g., from 90° forward to the chair back all the way to the rear parallel to the back rest 6 with the hinge axis 60 at the top. This embodiment allows when open a chair with minimal suggestions of its closing function, appearing like an uncomplicated attractive chair. When the chair is closed a user, with a single hand, can open the chair by pulling on the loops 3(*a*) and (*b*) or an alternative grip device. The chair can be closed with two actions. For example, the first action can be to articulate the sunshade 2 to the, but not exclusive to, the 90° forward compared to the back rest 6. The second action can be to hold finger pull loops 3(*a*) and 3(*b*) attached to the external connecting positon hinge on the chair back and sunshade 2, and closes the chair back lid to the horizontal position without risk of catching fingers in the narrowing gap of the closed chair back lid.

In opening this embodiment of the chair, the reverse can be achieved, for example, by doing the following: First, the combined sunshade 2 and back rest 6 can be lifted together, one or both of the finger pulls can be pulled with as little as one finger to lift the seat back to the open position. At this point the user can sit in the chair as is with sunshade lid articulated in the "sunshade" position. Second, before sitting the sunshade lid can be left in the sunshade position, or folded back, out of the way, into a "parallel position" with the back rest. Sunshade 2 can be attached with a position/torque/friction hinge or other mechanism so the sunshade's angle can be articulated in a multitude of positions.

When the sunshade lid 2 reaches the lower chair to complete the closure, a magnet latch, or other type of latch, catch or locking device can hold the sunshade lid in the closed position. When opened the armrests 12(*a*) and 12(*b*) can be folded open to double the surface area. The arm rests can have butler hinges to allow them be folded open and closed. Before closing, the armrests are folded inward to narrow the width of the closed chair and to seal off the user's contact surfaces from the elements. The entire chair can be closed into a box and held shut by internal magnets. These magnets can be placed on the inside surfaces of the portion of the chair which turns into a box to hold it together so that it does not pop open. The placement of these magnets can vary depending on the size and style of the chair.

Figure 5:
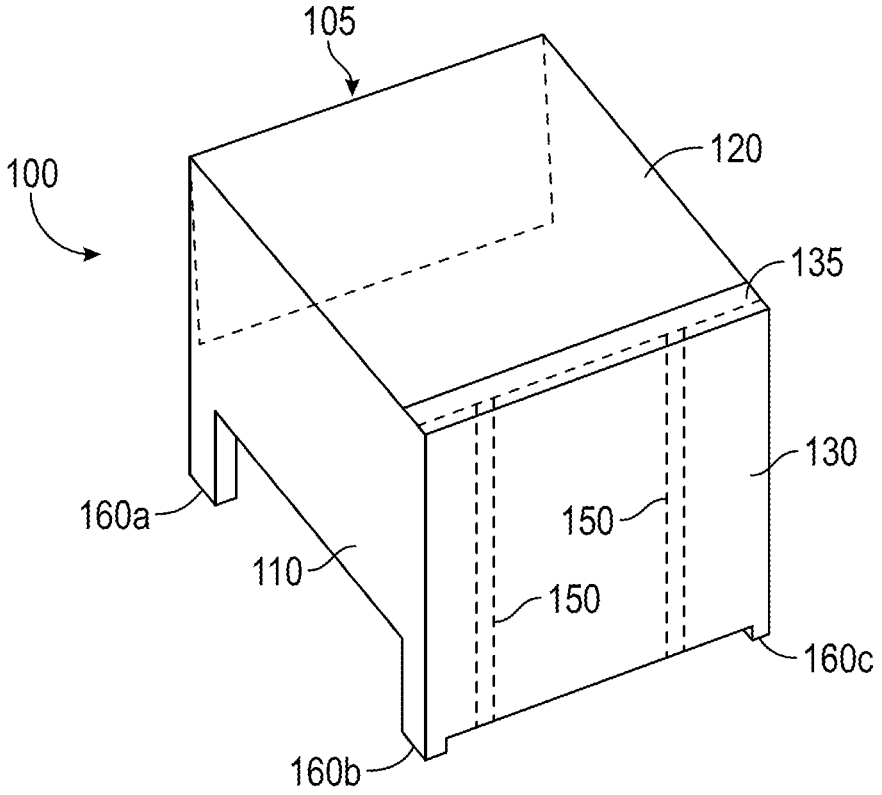
FIG. 5 is an illustration of another embodiment of a convertible chair of the inventive subject matter in a closed box configuration.
Figure 6:
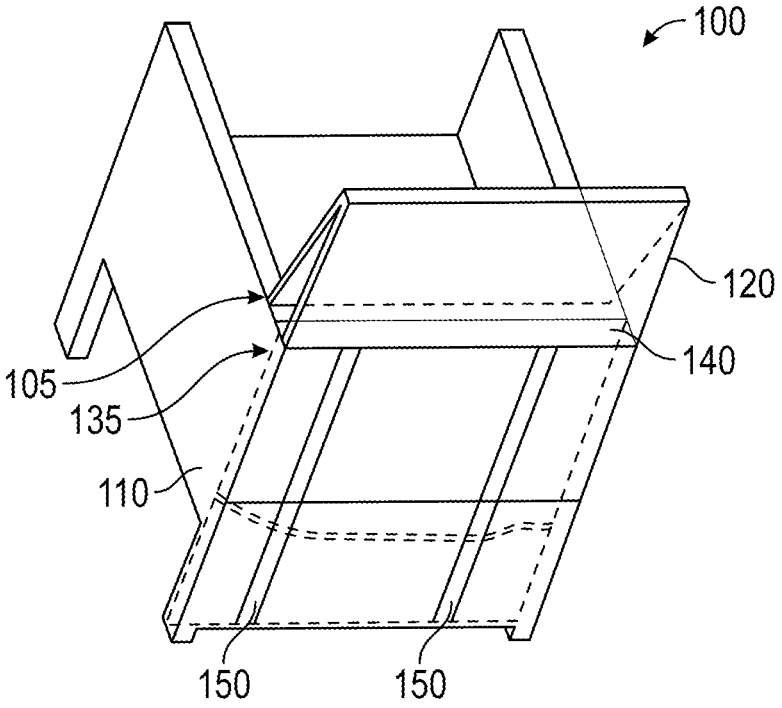
FIG. 6 an illustration of the chair of FIG. 5 in the process of being moved from a closed box configuration to an open chair configuration.

FIGS. 5-6 illustrate another embodiment of a convertible chair having a pocket and retractable cover. FIG. 5 illustrates convertible chair 100 in a closed box configuration. FIG. 6 illustrates convertible chair 100 in the process of being moved from a closed box configuration to an open chair configuration. Chair 100 comprises two side portions (e.g., 110), a front portion 105, a top portion 120, a back portion 130, which includes a pocket 140 that holds one or more retraction/deployment mechanisms 150, and is sized and dimensioned to receive at least a portion of (e.g., at least 50%, at least 60%, at least 70%, at least 90%, or the entirety of) the cover formed by the top portion 120 and front portion 105, for example, when they are folded such that the front portion 105 is in front of and parallel to top portion 120. Pocket 140 can be covered by an adjustable/open-close lid 135. Chair 100 also comprises legs 160*a*, 160*b*, 160*c*, and a fourth leg (not shown). Pocket 150 can comprise an open bottom so that any water or debris that is on the chair when retracted can freely drop out the bottom of the pocket to the ground below. In this embodiment, the chair back is the back panel enclosing the pocket 140 which can extend substantially the entire backside of the chair (e.g., along at least 75%, at least 80%, or at least 90% of each of the length and width of the back side). The top opening of the pocket 140 can be covered by a lid 135 when the cover (top portion 120 and front portion 105) are extended and the convertible chair is in a closed box configuration, and optionally when the cover is fully retracted into pocket 140.

The top portion 120 and front portion 105 can be lifted together to a configuration where they are parallel with the front portion 105 in front of the top portion 120, and then they can slide into the pocket 140 at the back of the chair when the chair is in its open seating position. Thus, the pocket can have a front to back length that is greater than a combined thickness of the top portion 120 and the front portion 105. The cover can then slide (retract) vertically on internal guides down into a rectangular pocket 140 behind the back cushion of the chair, thus concealing the entire retracted cover under a narrow door 135 extending along the width of the rear top of the chair. In some aspects, the narrow pocket 140 lid 135 can open to a 90° (or other) angle when open, then closes to be parallel with the armrests, and perpendicular to the retracted cover, giving the appearance when closed of a consistent top with the adjacent armrests. Double track guides can be used to guide the motion of the retracting and extending cover panels (top portion 120, front portion 105) into and from the pocket. The top portion 120 and front portion 105 can be connected together with a piano hinge or other type of hinge (e.g., torque/friction/torsion/position hinge). Connected to the track guides 150 are shuttles which slide vertically. The shuttles have attached hinges which connect to the rear of the cover to allow a controlled hinging of the upper cover from the vertical retraction position to the horizontal cover position.

In an embodiment of the chair it can have wheels attached to the bottom surface or feet so that the chair can be easily moved. The chair can also come with a locking mechanism so that it can't be opened or used unless unlocked.

In some embodiments, the material of the chair may be a vinyl or PVC material, such as 18-ounce vinyl-coated polyester. The material may be mildew and UV resistant to prolong the life of the cover and prevent fading or mildew buildup on the outer surface of the seat cushions as well as between the interior surfaces of the chair itself. In an alternative embodiment an aluminum skin can be placed on the entire exterior of the chair which makes it light weight yet sturdy and reduces the risk of rust or deterioration. Additionally, other materials such as leather or rubber, metal or wood may be used depending on the desired use or location of the convertible chair.

Figure 7A:
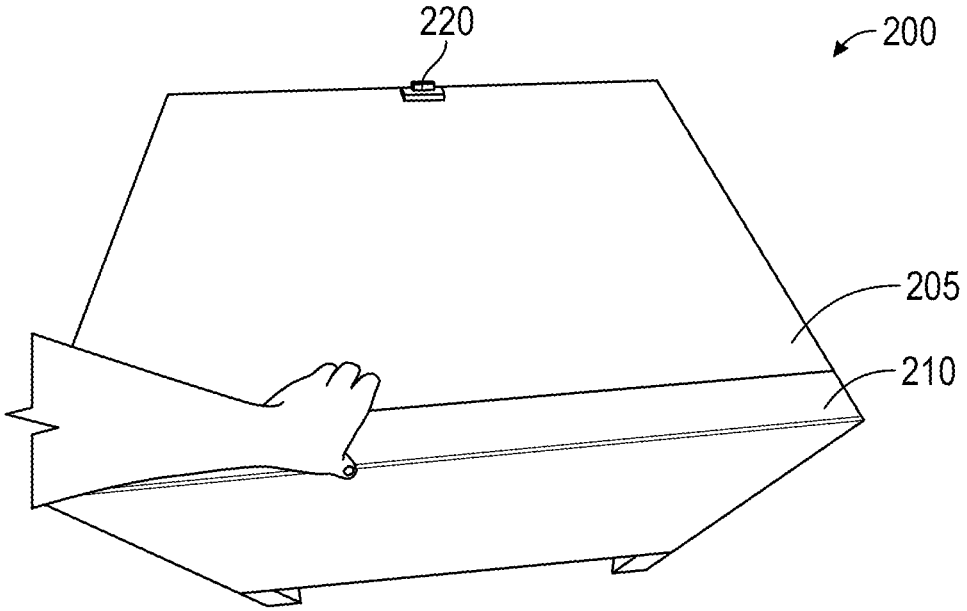
FIGS. 7A-7G illustrate another embodiment of a convertible chair of the inventive subject matter being adjusted from a closed box configuration to an open chair configuration.
Figure 7B:
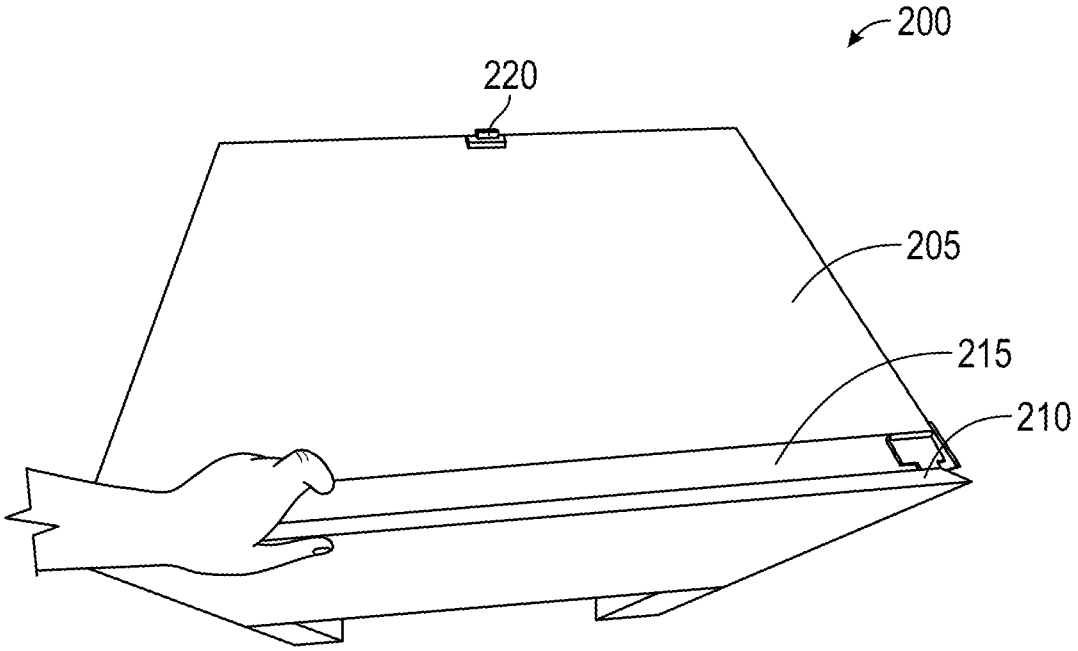
Figure 7C:
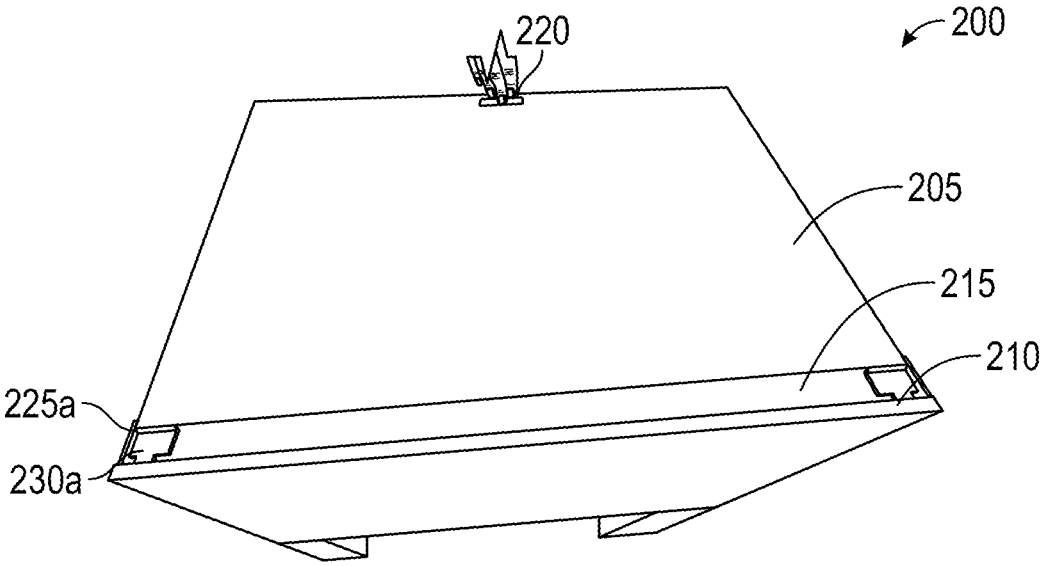
Figure 7D:
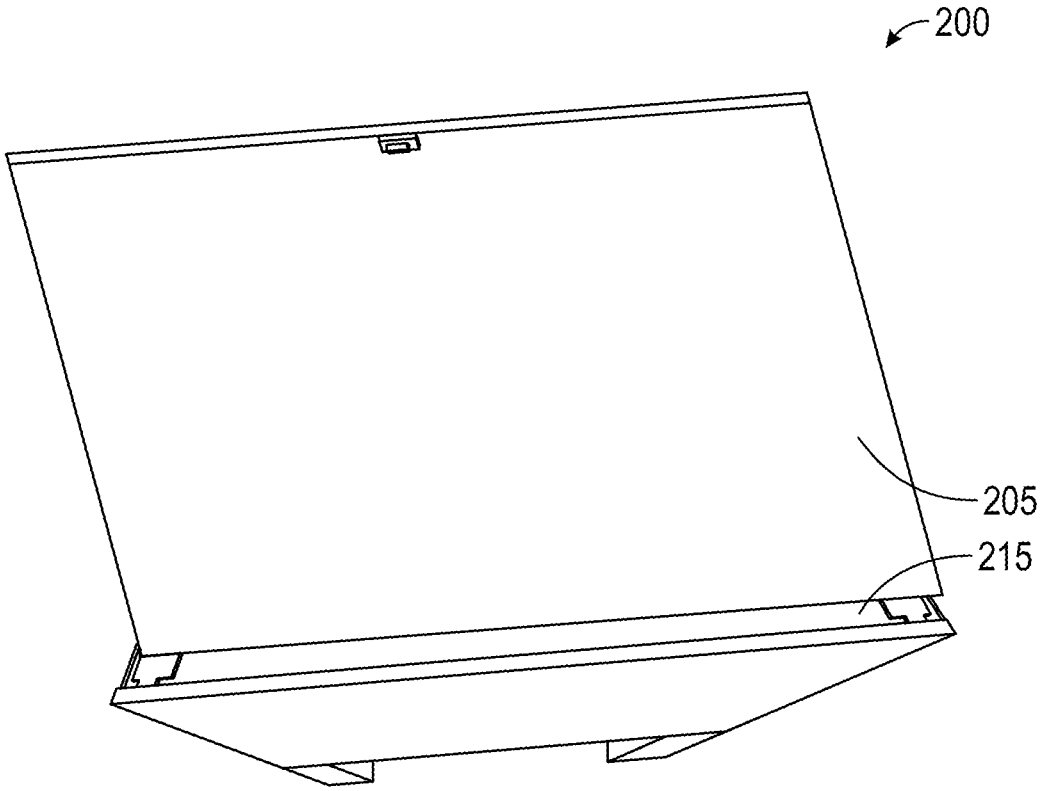
Figure 7E:
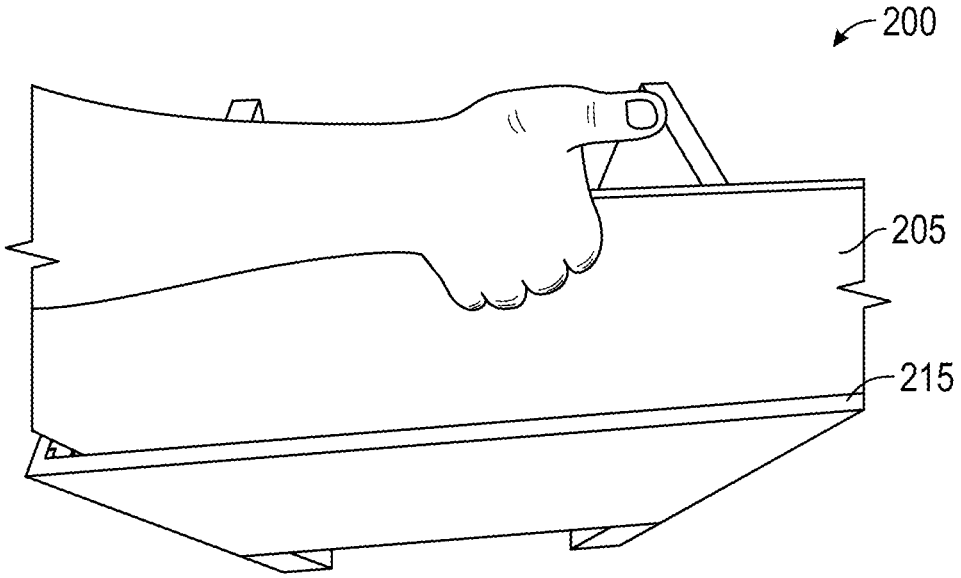
Figure 7F:
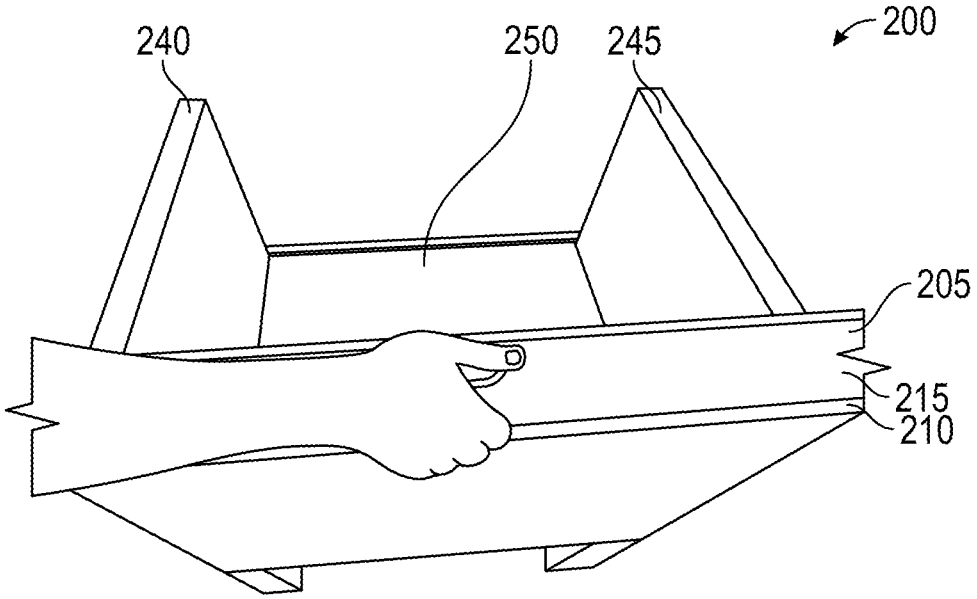
Figure 7G:
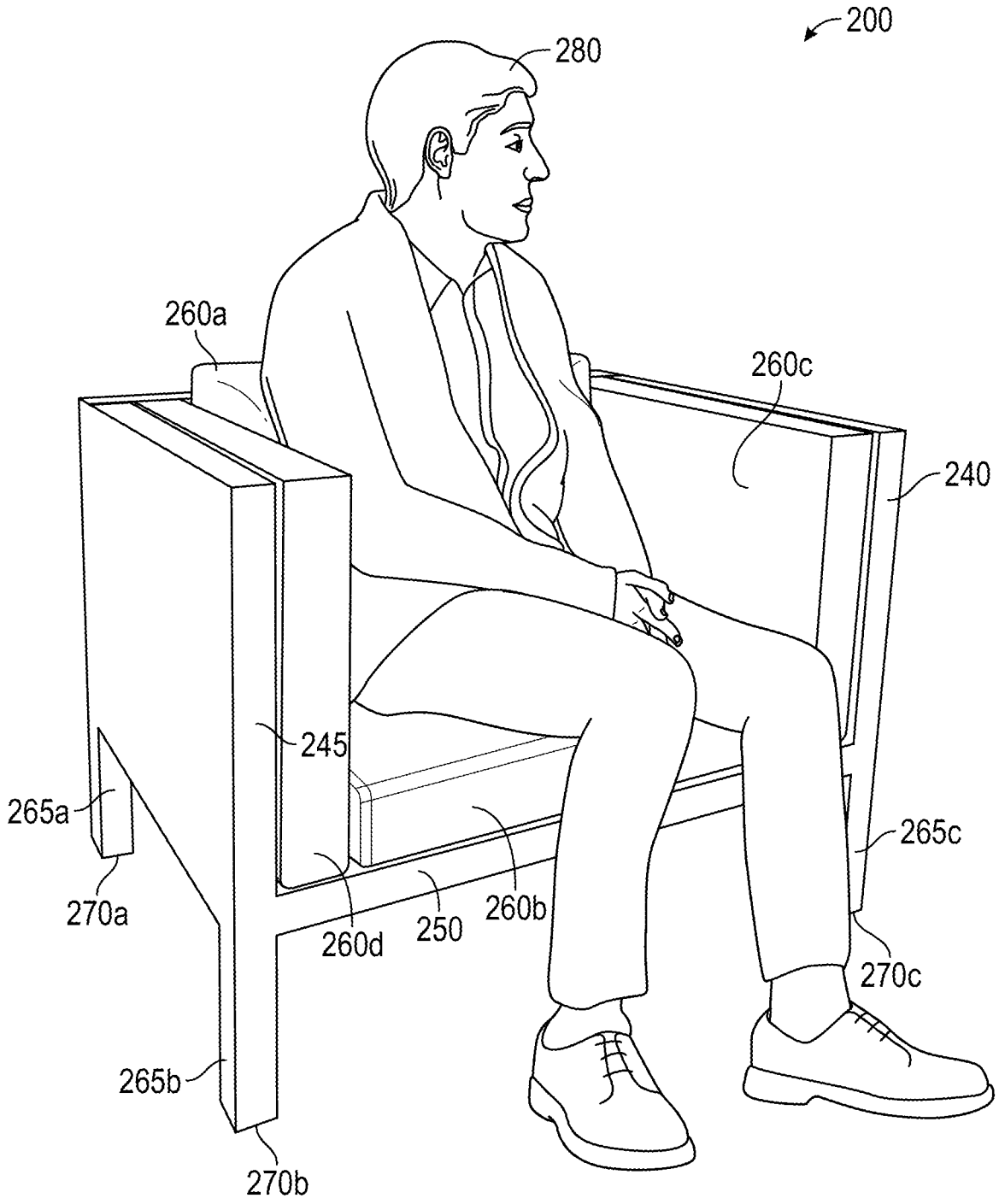

FIG. 7A-7G illustrate another embodiment of a convertible chair 200 of the inventive subject matter being adjusted from a closed box configuration to an open chair configuration. Convertible chair 200 comprises top portion 205 including a handle 220 (e.g., a recess handle), back portion, front portion (not shown), side portions 240, 245, seat portion 250, four legs (including 265*a, b, c*) each comprising a wheel or caster (e.g., 270*a, b, c*), and cushions 260*a, b, c, d*. Back portion comprises a pocket 215 sized and dimensioned to receive top portion 205 and front portion (not shown) and a pocket lid 210 that is configured to open and close. FIG. 7A shows convertible chair 200 in a closed box configuration. FIG. 7B shows pocket lid 210 being opened to expose pocket 215. FIG. 7C shows a user utilizing handle 220 to open the cover of the box, comprising top portion 205 and front portion that extends downward and about perpendicularly (between about 75-105 degrees) to top portion 205 when in the box configuration. As the user opens the cover, top portion and front portion fold onto one another. Top portion rotates or pivots relative to the back portion, for example, via a set of hinges (e.g., 225*a*). Front portion rotates or pivots relative to the top portion, for example, via a set of hinges. FIG. 7D shows the cover completely opened with the front portion folded in front of the top portion, and the cover vertically aligned with pocket 215. The cover can be guided by moving guides (e.g., 230*a*) coupled to a rack and pinion system (or other retraction and deployment mechanism) and retract into pocket 215 as shown in FIGS. 7E and 7F. In some embodiments, it is contemplated the cover can be placed in a pocket lacking a retraction and deployment mechanism. FIG. 7G shows chair 200 in an open chair configuration with couch cushions placed on or removably attached to different portions or panels of the chair. Cushion 260*a* is removably attached or otherwise placed over the inner surface (surface facing a seated user 280's back) of the back portion, cushion 260*b* is removably attached or otherwise placed over the inner surface (surface facing a seated user 280's bottom) of the seat portion, cushion 260*c* is removably attached or otherwise placed over an inner surface (surface facing a left side of a seated user 280) of the left side portion, and cushion 260*d* is removably attached or otherwise placed over an inner surface (surface facing a right side of a seated user 280) of the right side portion.

In the embodiment shown in FIGS. 7A-7G, it is contemplated that when the cover is extended and the chair is in a closed box configuration, all of the cushions and arm rest surfaces can be enclosed from above and front by the cover (top portion and front portion). Chair 200 is not a recliner and the retractable cover does not function as a sun shade. However, it should be appreciated that in some embodiments a chair as shown in 200 can comprise a cover that additionally or alternatively functions as a sunshade, or can include a recliner frame and be configured to recline. Additionally or alternatively, chair 200 can include a foot rest that is adjustable to be in a stowed away, to extend downward, to be forward extended, or to be in any other suitable configurations. Back portion can also be configured to be adjustable relative to the seat portion or ground, for example to allow for adjustments similar to a back portion of a seat of a vehicle. A recliner of the inventive subject matter can comprise any suitable reclining components, including for example, a pull handle or lever that a user pulls to cause the chair to recline, cables connected to the pull handle or lever that provide the leaning back function of the recliner, springs, power supplies, electric recline motor actuators, remote controller, etc.

In some aspects, a retraction and deployment mechanism may be provided, which may include components that stabilize, synchronize, assist the lifting/deployment of, or slow/dampen the retraction of, the chair cover in and out of a chair pocket. Suitable components can include, for example, any suitable rails, racks, pinions, guides, tracks, synchronizing axles, rotary dampers, loaded dampers, no friction guides, low friction stabilizers, torsion spring counterbalances, and concealed hinges. For example, a loaded rotary damper may be provided and, for example, directly built into the pinion, which can allow controlled deceleration of the chair cover into the pocket.

As another example, a torsion spring counterbalance assembly can be provided, which can do the heavy lifting of the chair cover, making it seem much lighter than it actually is (e.g., less than $1/10^{th}$ of the actual weight of the chair cover). Such mechanisms are often provided with garage doors, making it so that just about anyone can open the door, and can be useful for the convertible chairs described herein, which can include any suitable number of seats and chair covers (e.g., 1, 2, 3, 4, 5 of each of a seat, a top portion, and a front portion; 1, 2, 3, 4, 5 or more seats with a single large top portion and front portion to cover all of the seats; 1, 2, 3, 4, 5 or more seats with fewer chair covers than seats—e.g., a chair cover covering more than one seat when in a closed box configuration). A torsion spring counterbalance assembly can comprise two torsion springs that are wrapped around the pinion axle to assist in the deployment and retraction of the chair cover by balancing much of the cover weight when traveling vertically into and out of the pocket. The torsion loaded into the spring can safely slow the vertical retraction in a downward direction. It can also assist in the lifting of the cover up and out of the pocket. The spring can be held to the pinion axle by a shaft collar on one end to allow the spring to rotate and store the energy into the coil while another end of the spring can be held stationary. When the pinion rolls or rotates along the rack vertically, the torsional energy stored in the spring coil can be increased (e.g., down) or decreased (e.g., up) by the rotations.

Figure 8A:
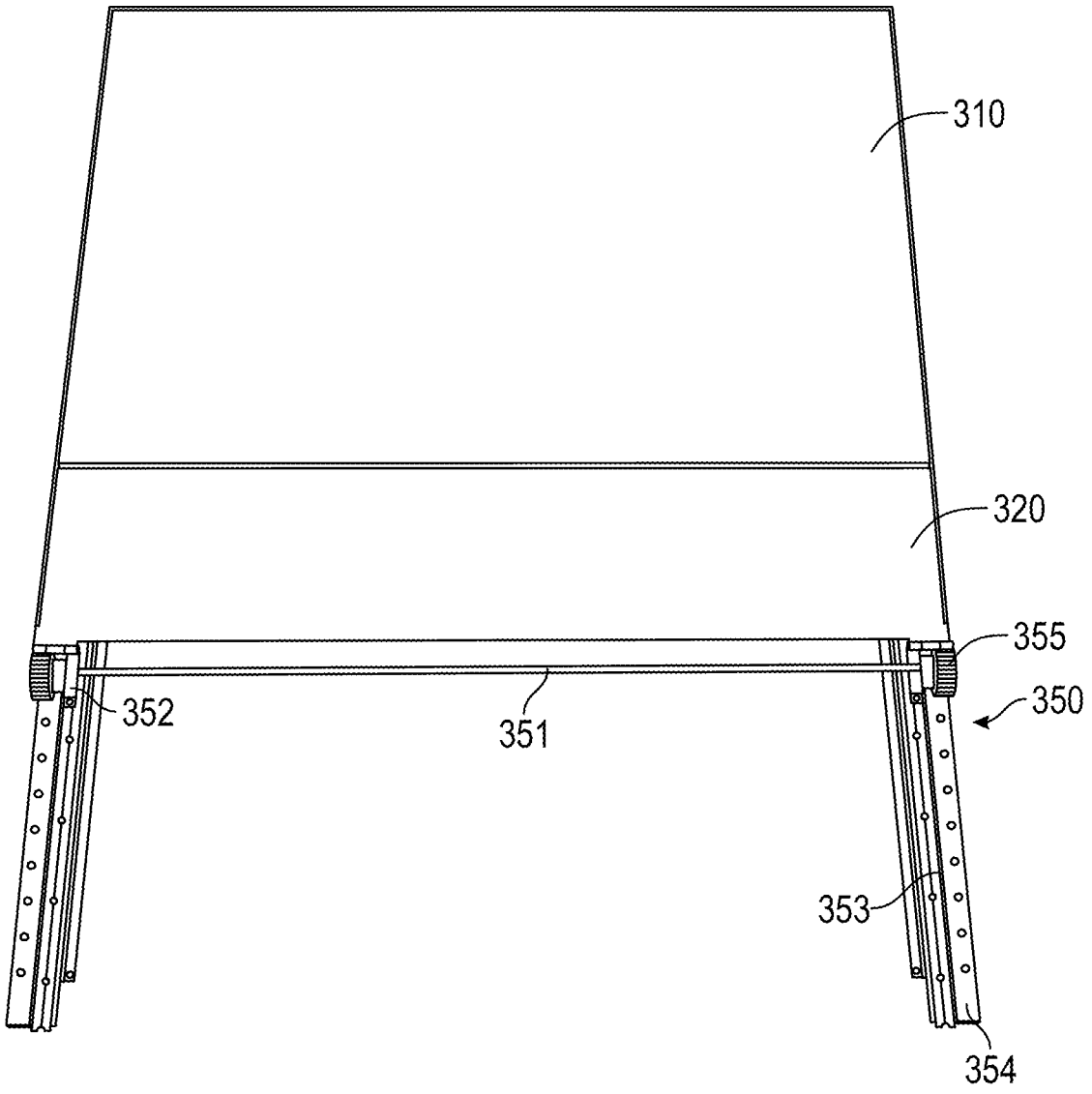
FIGS. 8A-8B illustrate an exemplary retraction and deployment mechanism of the inventive subject matter.
Figure 8B:
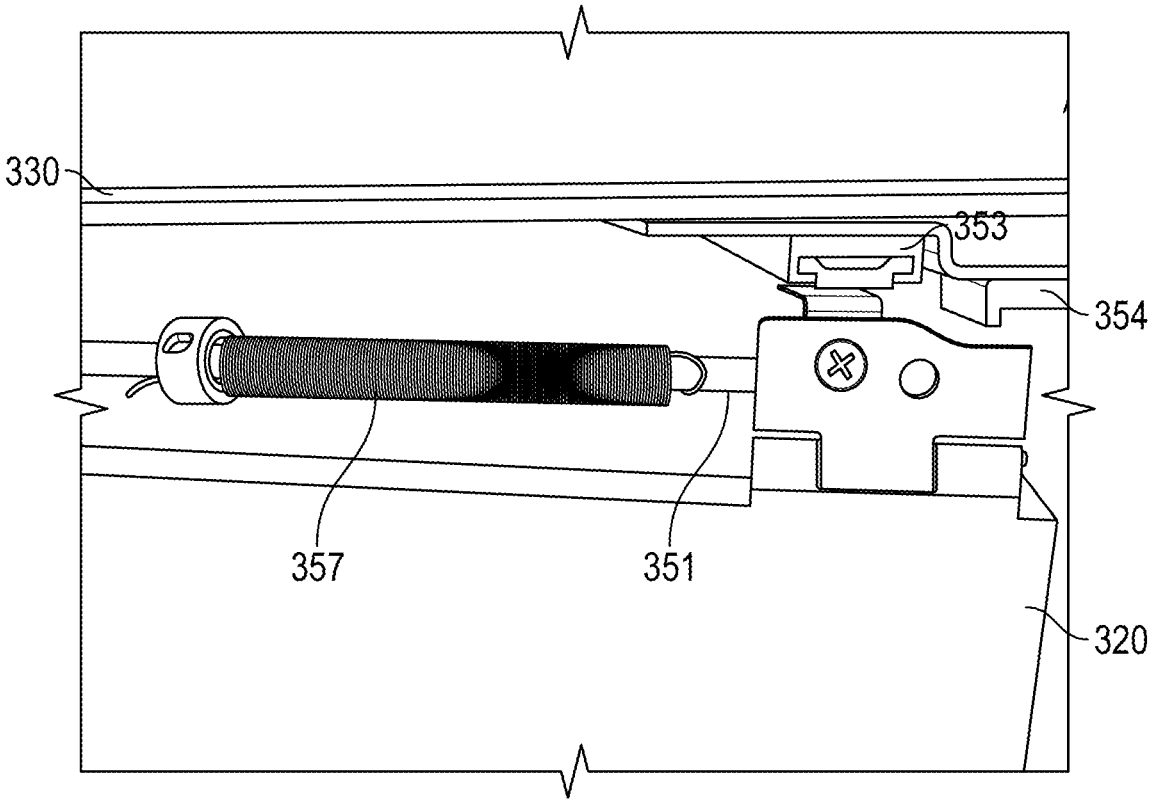

FIGS. 8A-8B illustrate an exemplary retraction and deployment mechanism of the inventive subject matter, which can be positioned within a pocket of a back portion of a convertible chair, or other suitable location(s). FIG. 8A shows the top portion 320 and front portion 310, which can form the chair cover. Top portion 320 may be horizontal when the convertible chair is in a box configuration, and front portion 310 may be vertical and in front of the top portion 320 when the convertible chair is in a box configuration. As best seen in FIG. 8A, before the chair cover is being retracted the top portion 320 and front portion 310 are rotated or pivoted such that both portions are vertical and parallel with one another. The cover portion can then be retracted vertically together into the pocket. Retraction and deployment mechanism 350, which is generally positioned partially or entirely within pocket 330, is shown removed from the pocket and in the middle of being retracted or deployed. Retraction and deployment mechanism 350 comprises, among other things, a dual rack and pinion system (two pinions 355, a pinion synchronizing axle shaft 351, two racks 354), two rail guide blocks 352, and two rails 353. The bottom of the pocket is represented at the bottom of the racks 354 and rails 353. FIG. 8B shows a torsion spring 357 of a torsion spring counterbalance assembly wound around the axle 351 from above pocket 330. The torsion spring 357 is mechanically coupled to pinion 355, the rack 354 and rail 353, and is wound/unwound when the chair cover is retracted and deployed from the pocket 330.

While an exemplary retraction and deployment mechanism comprising a rack and pinion system and torsion spring counterbalance assembly is described herein, it should be appreciated that any and all other suitable retraction and deployment mechanisms are contemplated herein.

Thus, specific examples of convertible chairs have been disclosed. It should be apparent, however, to those skilled in the art that many more modifications besides those already described are possible without departing from the inventive concepts herein. While examples and variations of the many aspects of the invention have been disclosed and described herein, such disclosure is provided for purposes of explanation and illustration only. Thus, various changes and modifications may be made without departing from the scope of the claims.

Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

The terminology used herein is for the purpose of describing particular cases only and is not intended to be limiting. The below terms are discussed to illustrate meanings of the terms as used in this specification, in addition to the understanding of these terms by those of skill in the art. As used herein and in the appended claims, the singular forms "a," "an," and "the" include plural referents unless the context clearly dictates otherwise. It is further noted that the claims can be drafted to exclude any optional element. As such, this statement is intended to serve as antecedent basis for use of such exclusive terminology as "solely," "only" and the like in connection with the recitation of claim elements, or use of a "negative" limitation.

Reference throughout this specification to "an embodiment" or "an implementation" means that a particular feature, structure, or characteristic described in connection with the embodiment is included in at least one embodiment or implementation. Thus, appearances of the phrases "in an embodiment" in various places throughout this specification are not necessarily all referring to the same embodiment or a single exclusive embodiment. Furthermore, the particular features, structures, or characteristics described herein may be combined in any suitable manner in one or more embodiments or one or more implementations.

The word "exemplary" is used herein to mean "serving as an example, instance, or illustration." Any aspect described herein as "exemplary" is not necessarily to be construed as preferred or advantageous over other aspects. Unless specifically stated otherwise, the term "some" refers to one or more.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Certain numerical values and ranges are presented herein with numerical values being preceded by the term "about." The term "about" is used herein to provide literal support for the exact number that it precedes, as well as a number that is near to or approximately the number that the term precedes. In determining whether a number is near to or approximately a specifically recited number, the near or approximating un-recited number may be a number which, in the context in which it is presented, provides the substantial equivalent of the specifically recited number.

Combinations such as "at least one of A, B, or C," "one or more of A, B, or C," "at least one of A, B, and C," "one or more of A, B, and C," and "A, B, C, or any combination thereof" include any combination of A, B, and/or C, and may include multiples of A, multiples of B, or multiples of C. Specifically, combinations such as "at least one of A, B, or C," "one or more of A, B, or C," "at least one of A, B, and C," "one or more of A, B, and C," and "A, B, C, or any combination thereof" may be A only, B only, C only, A and B, A and C, B and C, or A and B and C, where any such combinations may contain one or more member or members of A, B, or C.

All structural and functional equivalents to the components of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims.

What is claimed is:

1. A convertible chair, comprising:

a seat portion extending between a first side portion and a second side portion;

a back portion coupled to the seat portion, wherein the back portion is configured to be adjustable relative to the seat portion between at least two lockable positions forming different angles of between 90-180 degrees;

a cover portion comprising a front portion and a top portion, wherein the cover portion is configured to rotate relative to the back portion to convert the convertible chair from a closed box configuration to an open chair configuration; and wherein when the convertible chair is in a closed box configuration, a first gap between the front portion and the seat portion allows air to flow through portions of the chair from underneath the seat portion.

2. The convertible chair of claim 1, wherein the convertible chair is a multi-seat chair.

3. The convertible chair of claim 1, further comprising a set of legs extending downwardly from a bottom portion.

4. The convertible chair of claim 3, wherein each leg of the set of legs comprises at least one of a wheel and a caster.

5. The convertible chair of claim 1, wherein the seat portion is coupled to an adjustable foot rest.

6. The convertible chair of claim 1, wherein the first side portion comprises a first upper armrest panel that is hingedly coupled to a first side wall portion, and wherein the first upper armrest panel is adjustable about 180 degrees from a closed configuration to an open configuration.

7. The convertible chair of claim 1, wherein convertible chair is sized and dimensioned to store a first cushion when in the closed configuration.

8. The convertible chair of claim 7, wherein the first cushion comprises multiple sections.

9. The convertible chair of claim 7, wherein the convertible chair is sized and dimensioned to store a second cushion when in the closed configuration, with the second cushion positioned on top of the first cushion.

10. The convertible chair of claim 9, wherein the first cushion is configured to couple with the cover portion, and the second cushion is configured to couple with the seat portion when the convertible chair is in an open configuration.

11. The convertible chair of claim 1, wherein the cover portion comprises a handle.

12. The convertible chair of claim 11, wherein the handle comprises a recess handle.

13. The convertible chair of claim 1, further comprising a set of magnets positioned within the first and second side portions and the front portion and help maintain the convertible chair in the closed box configuration.

* * * * *